US008983319B2

(12) United States Patent
Sakamoto et al.

(10) Patent No.: US 8,983,319 B2
(45) Date of Patent: Mar. 17, 2015

(54) IMAGE FORMING APPARATUS

(75) Inventors: Takashi Sakamoto, Kanagawa (JP); Hiroaki Okuma, Kanagawa (JP); Daisuke Nakai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/589,722

(22) Filed: Aug. 20, 2012

(65) Prior Publication Data

US 2013/0195484 A1 Aug. 1, 2013

(30) Foreign Application Priority Data

Jan. 30, 2012 (JP) ..... 2012-016517

(51) Int. Cl.
*G03G 15/09* (2006.01)
*G03G 15/01* (2006.01)

(52) U.S. Cl.
CPC ..... *G03G 15/09* (2013.01); *G03G 15/0121* (2013.01)
USPC ..... 399/53

(58) Field of Classification Search
CPC ..... G03G 15/08
USPC ..... 399/27, 49, 53, 258
See application file for complete search history.

(56) References Cited

U.S. PATENT DOCUMENTS 7,110,684 B2 * 9/2006 Isobe et al. ..... 399/27
7,231,154 B2 * 6/2007 Sakamaki ..... 399/27
8,401,435 B2 * 3/2013 Shima et al. ..... 399/258
8,503,913 B2 * 8/2013 Sasaki ..... 399/255
2006/0159474 A1 * 7/2006 Suzuki et al. ..... 399/27
2010/0272476 A1 * 10/2010 Shima et al. ..... 399/258
2011/0229210 A1 * 9/2011 Sasaki ..... 399/258
2013/0136464 A1 * 5/2013 Okada ..... 399/27

FOREIGN PATENT DOCUMENTS

JP 2006-235376 * 7/2006 ..... G03G 15/08
JP 2006-235376 A 9/2006

* cited by examiner

*Primary Examiner* — Clayton E Laballe
*Assistant Examiner* — Kevin Butler
(74) *Attorney, Agent, or Firm* — Sughrue Mion, PLLC

(57) ABSTRACT

An image forming apparatus includes an image carrier that carries an electrostatic latent image; a developer supplying unit that supplies developer by being driven at a predetermined speed; a developing unit that develops the electrostatic latent image, while a transporting member transports the developer, a transport speed of the transporting member being switched to a plurality of speeds; a determining unit that determines whether or not an operation where a supply capacity of the developer supplying unit is greater than a transport capacity of the developing unit exceeds a predetermined threshold value and is continued; and a controller that performs control so that, when the determining unit determines that the operation exceeds the predetermined threshold value and is continued, an operation that was being executed immediately prior to the determination is stopped to forcefully drive the transporting member of the developing unit for a predetermined driving time.

5 Claims, 13 Drawing Sheets

IMAGE FORMING APPARATUS

CROSS-REFERENCE TO RELATED APPLICATIONS

This application is based on and claims priority under 35 USC 119 from Japanese Patent Application No. 2012-016517 filed Jan. 30, 2012.

BACKGROUND (i) Technical Field

The present invention relates to an image forming apparatus.

(ii) Related Art

Hitherto, as the aforementioned image forming apparatus, for example, the following type of image forming apparatus is available. This type of image forming apparatus has a structure that forms an image by driving a photoconductor drum while switching its speed to multiple speeds, and by developing an electrostatic latent image, formed on the surface of the photoconductor drum, using a developing device that is driven in accordance with a speed corresponding to the speed of the photoconductor drum. A developer supplying device supplies developer to the developing device when necessary. The developer supplying device may be driven at a constant speed regardless of the driving speed of the photoconductor drum.

SUMMARY

According to an aspect of the invention, there is provided an image forming apparatus including an image carrier that carries an electrostatic latent image; a developer supplying unit that supplies developer by being driven at a predetermined speed; a developing unit that develops the electrostatic latent image carried by the image carrier, while a transporting member transports the developer that is supplied from the developer supplying unit, a transport speed of the transporting member being switched to a plurality of speeds; a determining unit that determines whether or not an operation where a supply capacity of the developer supplying unit is greater than a transport capacity of the developing unit exceeds a predetermined threshold value and is continued; and a controller that performs control so that, when the determining unit determines that the operation exceeds the predetermined threshold value and is continued, an operation that was being executed immediately prior to the determination is stopped to forcefully drive the transporting member of the developing unit for a predetermined driving time.

BRIEF DESCRIPTION OF THE DRAWINGS

Exemplary embodiments of the present invention will be described in detail based on the following figures, wherein.

DETAILED DESCRIPTION

Exemplary embodiments of the present invention will hereunder be described with reference to the drawings.

First Exemplary Embodiment

Figure 1:
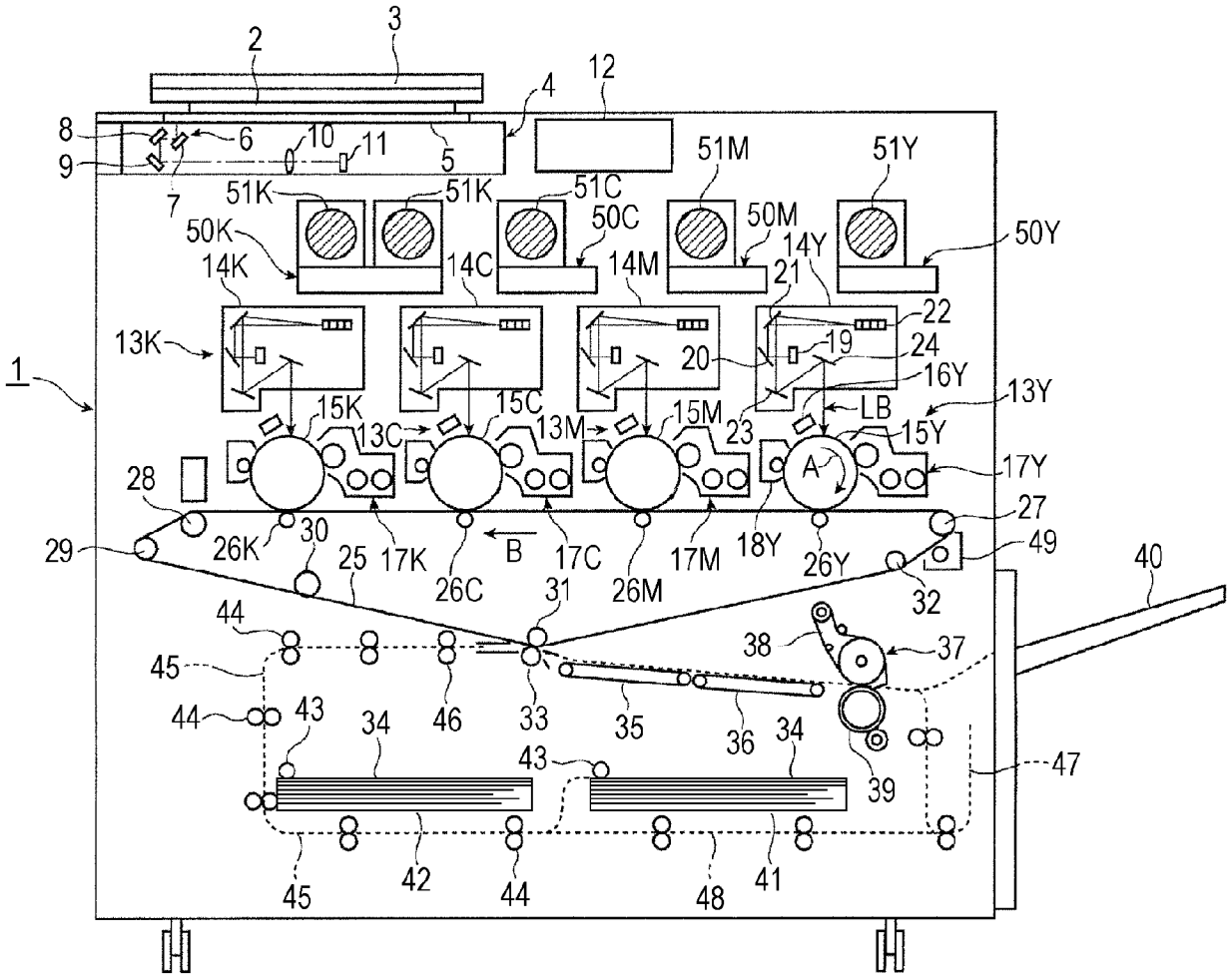
FIG. 1 illustrates the entire structure of an image forming apparatus according to a first exemplary embodiment of the present invention.

FIG. 1 shows a tandem full-color image forming apparatus serving as an image forming apparatus according to a first exemplary embodiment of the present invention. The tandem full-color image forming apparatus includes an image reading device, and also functions as a full-color copying machine. The image forming apparatus need not include an image reading device. The present invention is obviously not limited to a tandem image forming apparatus. Therefore, the present invention may be applied to, for example, a monochromatic image forming apparatus including only one photoconductor drum, or to what is called a four-cycle full-color image forming apparatus.

In FIG. 1, reference numeral 1 denotes the body of the image forming apparatus, with an image reading device 4 that reads an image on an original 2 being disposed at one end (left end in FIG. 1) of an upper portion of the body 1 of the image forming apparatus. In the image reading device 4, a light source 6 illuminates the original 2 placed on a platen glass 5 while the original 2 is pressed by an original holding member 3, and an image formed by light reflected from the original 2 scans and exposes an image reading element 11 (including, for example, a charged coupled device (CCD)) through a reduction optical system (including a full-rate mirror 7, half-rate mirrors 8 and 9, and an imaging lens 10). The scanning and the exposure cause the image reading element 11 to read the image on the original 2 with a predetermined dot density.

The image on the original 2 read by the image reading device 4 is sent to an image processing device 12 as, for example, pieces of image data of three colors, red (R), green (G), and blue (B), each piece of image data being, for example, eight bits. The image processing device 12 performs predetermined image processing operations on the pieces of image data of the original 2. The image processing operations include, for example, shading correction, positional displacement correction, brightness/color space conversion, gamma correction, frame erasure, and color/movement edition. The pieces of image data on which the predetermined image processing operations have been performed by the image processing device as mentioned above are converted into pieces of image data of four colors, cyan (C), magenta (M), yellow (Y), and black (K), by the image processing device 12. The number of colors of the pieces of image data that are converted by the image processing device 12 is not limited to the four colors, cyan (C), magenta (M), yellow (Y), and black (K). Therefore, the colors of the pieces of image data may be converted into any number of colors, such as six colors including highly saturated cyan (HC) and highly saturated magenta (HM) in addition to the aforementioned four colors. The pieces of image data that are input to the controller 12 may obviously be sent from, for example, a personal computer through a communication line (not shown).

In the exemplary embodiment, the image forming apparatus includes image forming units that form images using toners of different colors.

That is, as shown in FIG. 1, in the interior of the body 1 of the image forming apparatus 1 according to the exemplary embodiment, four image forming sections 13Y, 13M, 13C, and 13K corresponding to the colors, yellow (Y), magenta (M), cyan (C), and black (K), respectively, are disposed side by side horizontally so as to be spaced apart from each other by a certain interval. The image forming sections 13Y, 13M, 13C, and 13K serve as the image forming units. The order of disposition of the image forming sections 13Y, 13M, 13C, and 13K for yellow (Y), magenta (M), cyan (C), and black (K), respectively, is not limited to that shown in FIG. 1. The image forming sections 13Y, 13M, 13C, and 13K for yellow (Y), magenta (M), cyan (C), and black (K), respectively, are each formed into a unit, and are each replaceably mounted individually to the body 1 of the image forming apparatus.

As shown in FIG. 1, the four image forming sections 13Y, 13M, 13C, and 13K all have basically the same structure, and only differ in the type of toner that they use. Roughly speaking, each of the image forming sections 13Y, 13M, 13C, and 13K includes a photoconductor drum 15, a scorotron 16, an image exposing device 14, a developing device 17, and a cleaning device 18. Each photoconductor drum 15 serving as an image carrier is driven along the direction of arrow A at predetermined rotational speeds. Each scorotron 16 serving as a first charging unit uniformly charges the surface of the corresponding photoconductor drum 15. The image exposing devices 14 serving as latent image forming units form electrostatic latent images by exposing the surfaces of the photoconductor drums 15 to images corresponding to the respective colors. The developing devices 17 serving as developing units develop the electrostatic latent images formed on the corresponding photoconductor drums 15 with toners of the corresponding colors. The cleaning devices 18 clean residual toner remaining on the photoconductor drums 15 after transfer.

In the exemplary embodiment, the speed of an image forming operation that is determined by the rotational speed of each photoconductor drum 15, that is, a process speed (peripheral speed) is switchable in four stages. These four stages are a full-color image forming mode corresponding to the highest speed of 308 mm/s, a high image quality mode corresponding to the second highest speed of 255 mm/s, a first thick-paper mode corresponding to the third highest speed of 200 mm/s for forming images on a recording medium that is thick paper having a relatively small paper weight, and a second thick-paper mode corresponding to the lowest speed of 103 mm/s for forming images on a recording medium that is thick paper having a relatively large paper weight. The process speed is not limited to a speed that is switched in four stages. Therefore, the process speed may obviously be switched in stages that is less than or greater than four stages.

The image forming apparatus is formed so that, for example, driving speeds of the developing devices 17 are switched in four stages in accordance with the process speeds determined by the rotational speeds of the corresponding photoconductor drums 15.

As shown in FIG. 1, in each image exposing device 14, a semiconductor laser 19 is modulated in accordance with image data, and a laser beam LB from the semiconductor laser 19 is emitted in accordance with the image data. The laser beam LB emitted from the semiconductor laser 19 is deflected by a rotating polygonal mirror 22 through reflecting mirrors 20 and 21 for scanning. With the focal length being adjusted in accordance with a scanning angle by a f-θ lens (not shown), each photoconductor drum 15 serving as an image carrier is scanned and exposed through reflecting mirrors 23 and 24. The image exposing devices 14 are not limited to devices that perform image exposure by deflecting the laser beams LB and scanning with the laser beams LB. For example, they may be devices using LED arrays in which LED elements are disposed along an axial direction of the photoconductor drums 15. Compared to the image exposing devices 14 that perform image exposure by deflecting the laser beams LB and scanning with the laser beams LB, the image exposing devices 14 using the LED arrays may be made considerably smaller, which is desirable from the viewpoint of reducing the size of the entire image forming apparatus.

The photoconductor drums 15Y, 15M, 15C, and 15K of the image forming sections 13Y, 13M, 13C, and 13K corresponding to yellow (Y), magenta (M), cyan (C), and black (K) are uniformly charged by scorotrons 16Y, 16M, 16C, and 16K to predetermined potentials. Thereafter, the image processing device 12 successively outputs the pieces of image data of the corresponding colors to the image exposing devices 14Y, 14M, 14C, and 14K of the image forming sections 13Y, 13M, 13C, and 13K for the corresponding colors, yellow (Y), magenta (M), cyan (C), and black (K). The light beams LB exiting from the corresponding image exposing devices 14Y, 14M, 14C, and 14K in accordance with the pieces of image data scan the surfaces of the corresponding photoconductor drums 15Y, 15M, 15C, and 15K along a main scanning direction (that is, an axial direction of the photoconductor drums 15) for exposing the surfaces to the light beams LB, to form electrostatic latent images. The electrostatic latent images formed on the corresponding photoconductor drums 15Y, 15M, 15C, and 15K are developed as toner images of the corresponding colors, yellow (Y), magenta (M), cyan (C), and black (K), by the corresponding developing devices 17Y, 17M, 17C, and 17K.

As shown in FIG. 1, the toner images of the corresponding colors, yellow (Y), magenta (M), cyan (C), and black (K), that are successively formed on the photoconductor drums 15Y, 15M, 15C, and 15K of the corresponding image forming sections 13Y, 13M, 13C, and 13K are first-transferred to an intermediate transfer belt 25 while the toner images are superposed upon the intermediate transfer belt 25 by first transfer rollers 26Y, 26M, 26C, and 26K. The intermediate transfer belt 25 serving as an intermediate transfer body is disposed below the image forming sections 13Y, 13M, 13C, and 13K.

The intermediate transfer belt 25 extends on rollers, such as a drive roller 27, a driven roller 28, a tension applying roller 29, a driven roller 30, a back support roller 31 of a second transfer section, and a driven roller 32, by a predetermined tension. The drive roller 27 that is rotationally driven by a dedicated drive motor (not shown) that excels in achieving constant speed is driven so as to circulate at a speed that is substantially equal to the rotational speeds (peripheral speeds) of the photoconductor drums 15Y, 15M, 15C, and 15K in the direction of arrow B. As the intermediate transfer belt 15, for example, a synthetic resin film, such as a polyimide resin film or a polyamide-imide resin film, having flexibility and formed into an endless belt may be used.

The toner images of the corresponding colors, yellow (Y), magenta (M), cyan (C), and black (K), that have been transferred to the intermediate transfer belt 25 in a superimposed state are second-transferred collectively to recording paper 34 (serving as a recording medium), by a second-transfer roller 33 that press-contacts the back support roller 31 with the intermediate transfer belt 25 being disposed therebetween. The recording paper 34 to which the toner images of the corresponding colors have been transferred is transported to a fixing device 37 (serving as a fixing unit) by a double belt including transfer belts 35 and 36. The recording paper 34 to which the toner images of the corresponding colors have been transferred is subjected to a fixing operation using heat provided by a heating belt 38 of the fixing device 37 and pressure provided by a pressure roller 39 of the fixing device 37. Thereafter, in the case of one-side printing, the recording paper 34 is discharged as it is to a discharge tray 40 provided at an outer portion of the body 1 of the image forming apparatus.

As shown in FIG. 1, pieces of recording paper 34 having a predetermined size or formed of a predetermined material are temporarily transported from either one of sheet-feed trays 41 and 42 to registration rollers 46 while the pieces of recording paper 34 are separated one at a time through a sheet transport path 45 including a sheet-feed roller 43 and a pair of sheet transport rollers 44. The recording paper 34 supplied from either one of the sheet-feed trays 41 and 42 is sent out to a second transfer position of the intermediate transfer belt 25 by the registration rollers 46 that are rotationally driven at a predetermined timing.

When forming images on both sides of the recording paper 34 by the image forming apparatus, the recording paper 34 to whose one side the images have been fixed by the fixing device 37 is not discharged out of the image forming apparatus. Instead, a switching gate (not shown) causes the transport path of the recording paper 34 to be switched to a lower transport path, as a result of which the front and back of the recording paper 34 are reversed through a reversal sheet transport path 47. Thereafter, the reversed recording paper 34 is transported again to the second transfer position of the intermediate transfer belt 25 through a duplex-printing sheet transport path 48 and the ordinary sheet transport path 45, so that images are transferred to the back side of the recording paper 34. Thereafter, the images are fixed by heat provided by the heating belt 38 of the fixing device 37 and pressure provided by the pressure roller 39 of the fixing device 37. The recording paper 34 to whose back side the images have been fixed is discharged to the discharge tray 40 provided at the outer portion of the body 1 of the image forming apparatus.

The surfaces of the photoconductor drums 15 to which the toner images have been first-transferred are cleaned by cleaning devices 18. A surface of the intermediate transfer belt 25 to which the toner images have been second-transferred is cleaned by a belt cleaning device 49 disposed at the drive roller 27.

Figure 2:
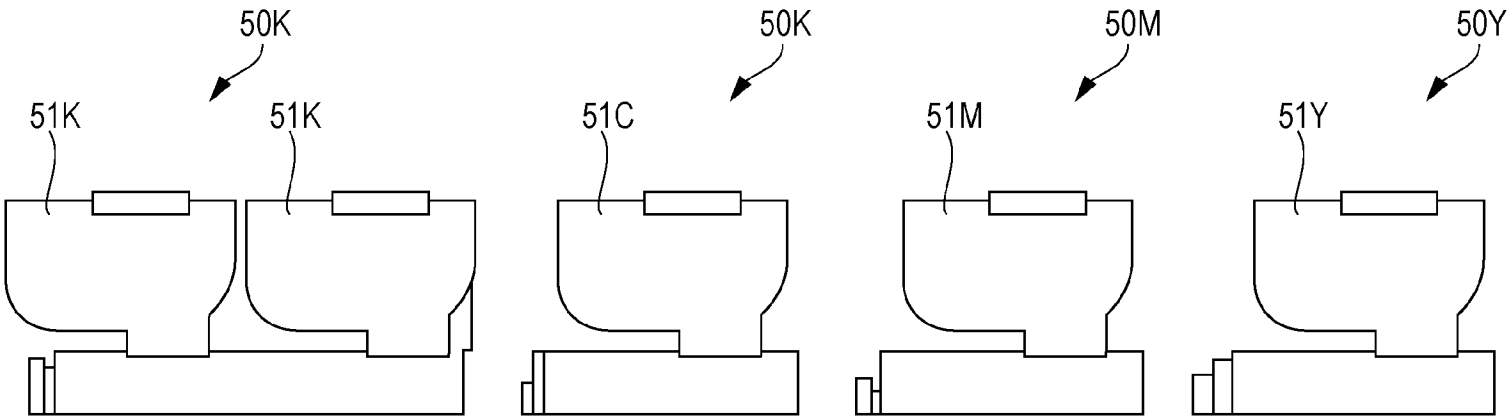
FIG. 2 illustrates the structures of developer supplying devices according to the first exemplary embodiment of the present invention.

As shown in FIGS. 1 and 2, developer supplying devices 50Y, 50M, 50C, and 50K are provided at the corresponding image forming sections 13Y, 13M, 13C, and 13K for yellow (Y), magenta (M), cyan (C), and black (K). The developer supplying devices 50Y, 50M, 50C, and 50K supply developers including at least toners of colors corresponding to the respective developing devices 17Y, 17M, 17C, and 17K. Although, in the exemplary embodiment, the developer supplying devices 50Y, 50M, 50C, and 50K are formed so as to supply the developers including only toners, the developer supplying devices 50Y, 50M, 50C, and 50K may obviously be formed so as to supply developers including toners and carriers.

As shown in FIGS. 1 and 2, the developer supplying devices 50Y, 50M, 50C, and 50K include, respectively, a toner cartridge 51Y, a toner cartridge 51M, a toner cartridge 51C, and toner cartridges 51K, serving as developer containers that contain toners as developers of the corresponding colors, yellow (Y), magenta (M), cyan (C), and black (K). Since the amount of consumption of black (K) toner is relatively large compared to that of each of the other color toners, two black (K) toner cartridges 51K are disposed. When one of the toner cartridges 51K becomes empty, the other toner cartridge 51K is used.

Figure 3:
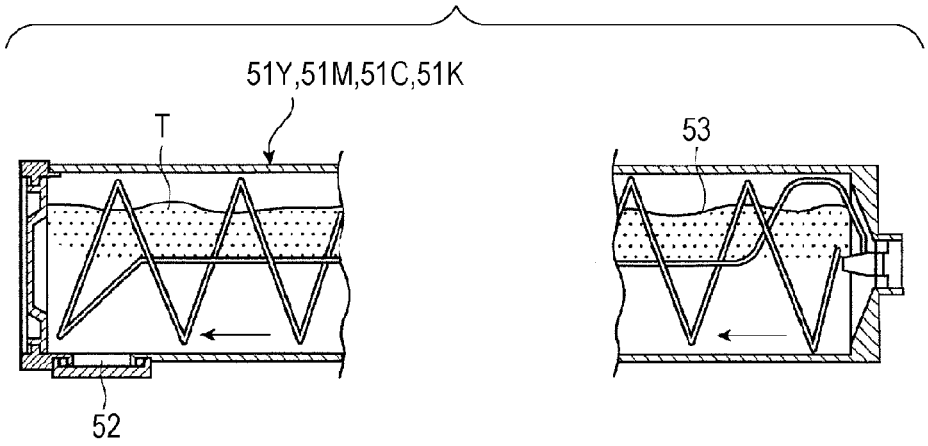
FIG. 3 is a sectional view of the structure of each toner cartridge.
Figure 4:
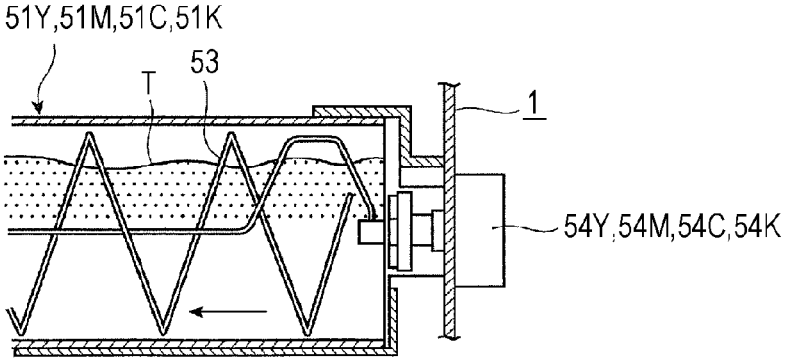
FIG. 4 is a sectional view of the structure of each toner cartridge that is mounted to a body of the image forming apparatus.

As shown in FIG. 3, toners T of the corresponding colors are contained in the corresponding toner cartridges 51Y, 51M, 51C, and 51K. In addition, as shown in FIG. 3, agitators 53 are rotatably disposed in the corresponding toner cartridges 51Y, 51M, 51C, and 51K. The agitators 53 serve as toner transporting members for supplying the toners T from corresponding toner supply openings 52 while mixing the toners T, and are formed by spirally bending linear members formed of a metal or synthetic resin. Each toner supply opening 52 opens in a bottom portion at one end of the corresponding toner cartridge in a longitudinal direction. As shown in FIG. 4, by mounting the toner cartridges 51Y, 51M, 51C, and 51K to the body 1 of the image forming apparatus, the agitators 53 are connected to corresponding cartridge motors 54Y, 54M, 54C, and 54K, and are rotationally driven thereby. The cartridge motors 54Y, 54M, 54C, and 54K, serving as first driving units, are provided at the body 1 of the image forming apparatus. As the cartridge motors 54Y, 54M, 54C, and 54K, for example, DC motors are used. The reasons DC motors are used as the cartridge motors 54Y, 54M, 54C, and 54K are that DC motors themselves are relatively smaller than other types of motors, can be made small even if combined with a speed-reduction gear box, and can be disposed in the interior of the body 1 of the image forming apparatus with a high degree of freedom. Regardless of a process speed, the cartridge motors 54Y, 54M, 54C, and 54K are driven at a predetermined constant speed corresponding to, for example, the highest process speed.

Figure 5:
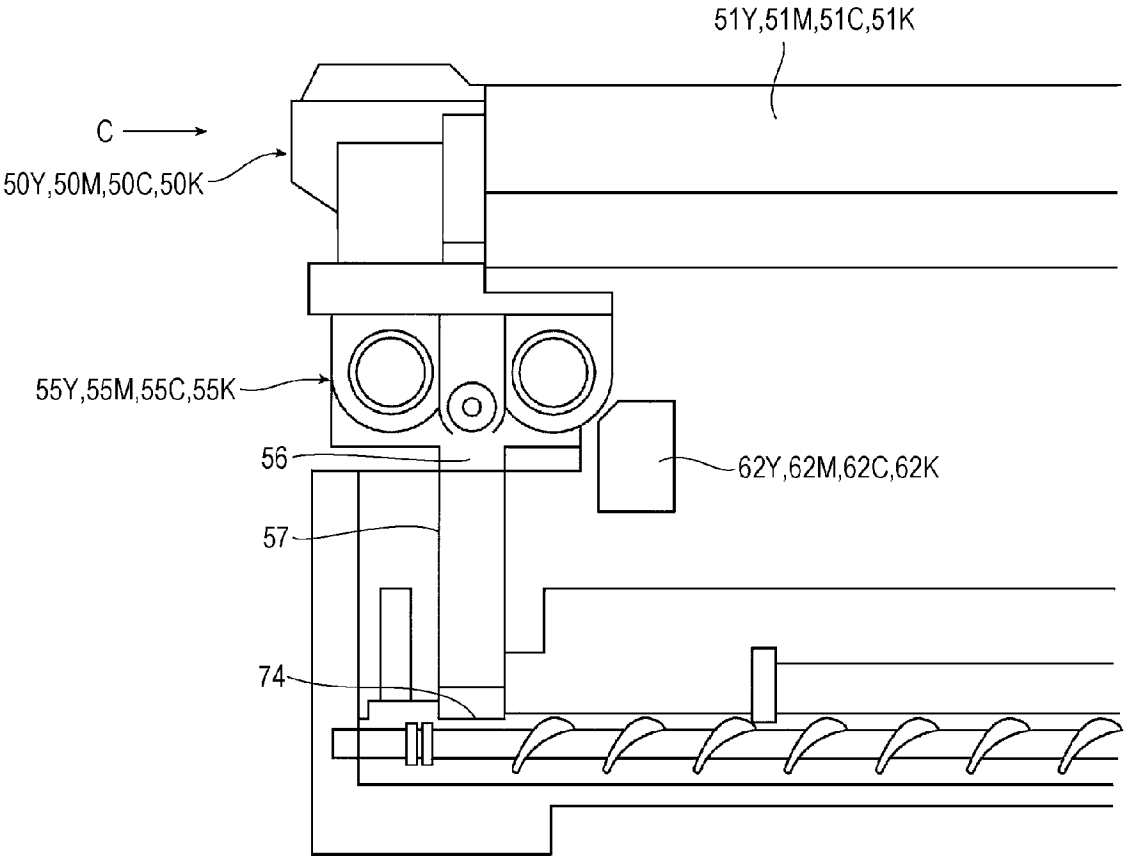
FIG. 5 illustrates the structure of a toner supply path for supplying toner to a developing device from the corresponding toner cartridge.

As shown in FIG. 5, the developer supplying devices 50Y, 50M, 50C, and 50K include corresponding developer storing devices 55Y, 55M, 55C, and 55K that temporarily store the toners that are supplied from the corresponding toner cartridges 51Y, 51M, 51C, and 51K, and that supply the toners to the developing devices 17Y, 17M, 17C, and 17K while mixing the toners. The developer storing devices 55Y, 55M, 55C, and 55K transport the toners T while mixing the toners T with predetermined amounts of toners T that are supplied from the toner supply openings 52 of the corresponding toner cartridges 51Y, 51M, 51C, and 51K being temporarily stored in the developer storing devices 55Y, 55M, 55C, and 55K. Then, through drop paths 57, the toners T are supplied and drop towards the corresponding developing devices 17Y, 17M, 17C, and 17K from toner replenishment openings 56. Each toner replenishment opening opens in a bottom surface at one end of a corresponding one of the developer storing devices 55Y, 55M, 55C, and 55K.

Figure 6:
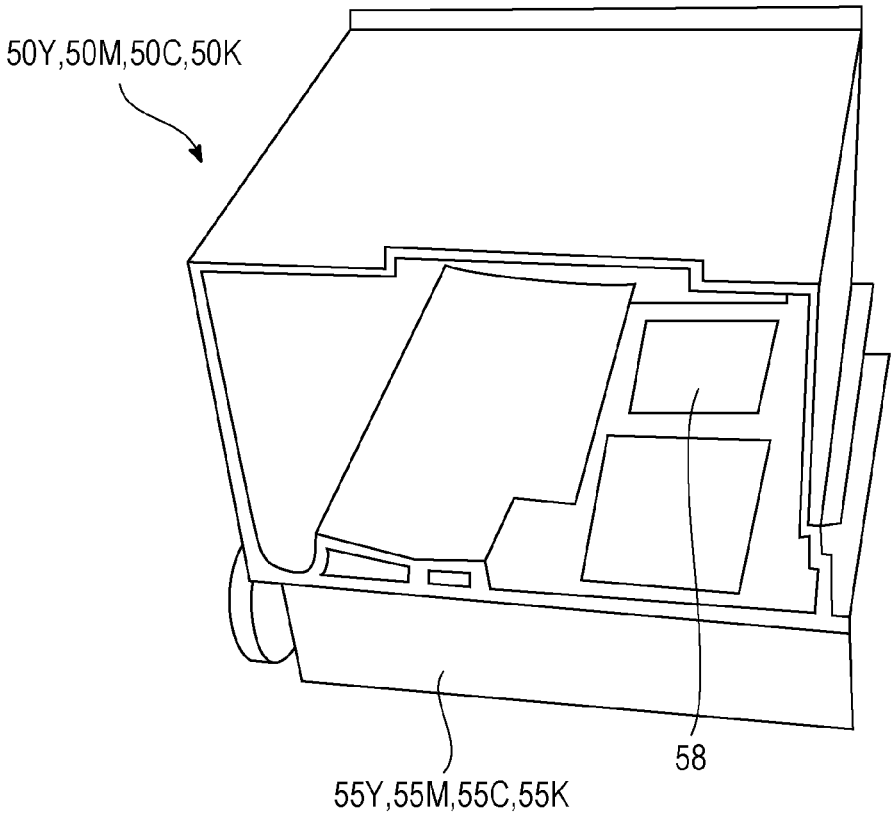
FIG. 6 is a perspective view of the structure of each developer supplying device.

FIG. 6 is a perspective view of a state in which the toner cartridges 51Y, 51M, 51C, and 51K are removed from the corresponding toner cartridges 50Y, 50M, 50C, and 50K, as viewed obliquely from thereabove in the direction of arrow C in FIG. 5. An area 58 (described later) that is adjacent to the corresponding one of the developer storing devices 55Y, 55M, 55C, and 55K to which the toner T is supplied from the toner supply opening 52 of the corresponding one of the toner cartridges 51Y, 51M, 51C, and 51K can be seen.

Figure 7:
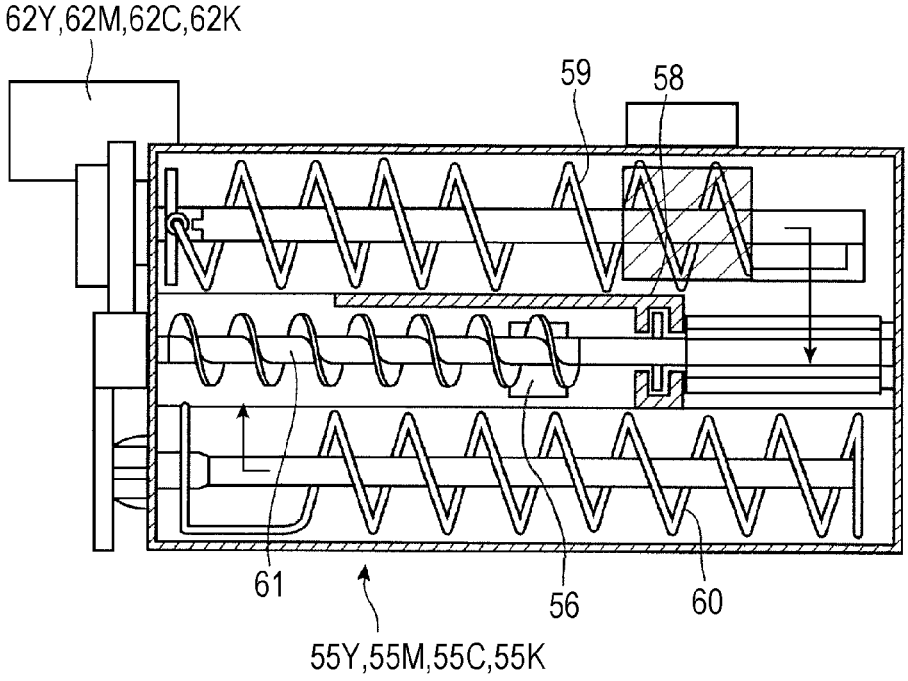
FIG. 7 is a sectional view of the structure of each developer storing device.

As shown in FIG. 7, in the interiors of the developer storing devices 55Y, 55M, 55C, and 55K, the toners T are supplied from the toner supply openings 52 of the toner cartridges 51Y, 51M, 51C, and 51K to the rectangular areas 58 shown by broken lines. Two spiral agitators 59 and 60 are disposed parallel to each other in each of the developer storing devices 55Y, 55M, 55C, and 55K. The agitators 59 and 60 transport the toner T supplied from the corresponding one of the toner cartridges 51Y, 51M, 51C, and 51K so as to circulate the toner T while mixing the toner T. An auger 61 having the form of a screw is disposed between the two agitators 59 and 60 in each of the developer storing devices 55Y, 55M, 55C, and 55K. The augers 61 transport a portion of the toners T that are transported so as to replenish the developing devices 17Y, 17M, 17C, and 17K with the toners T while being mixed so as to be circulated by the two agitators 59 and 60. The augers 61 are formed so that the toners T from the corresponding toner replenishment openings 56 that open in the bottom surfaces of the corresponding developer storing devices 55Y, 55M, 55C, and 55K drop and are supplied to the corresponding developing devices 17Y, 17M, 17C, and 17K. As shown in FIGS. 5 and 7, the two agitators 59 and 60 and the auger 61 are rotationally driven at a predetermined constant speed through gears by a corresponding one of the toner supply motors 62Y, 62M, 62C, and 62K serving as second drive motors. As the toner supply motors 62Y, 62M, 62C, and 62K, for example, DC motors may be used due to the same reasons that DC motors are used for the cartridge motors 54Y, 54M, 54C, and 54K. The toner supply motors 62Y, 62M, 62C, and 62K are also driven at a predetermined constant rotational speed regardless of the process speed.

Figure 8:
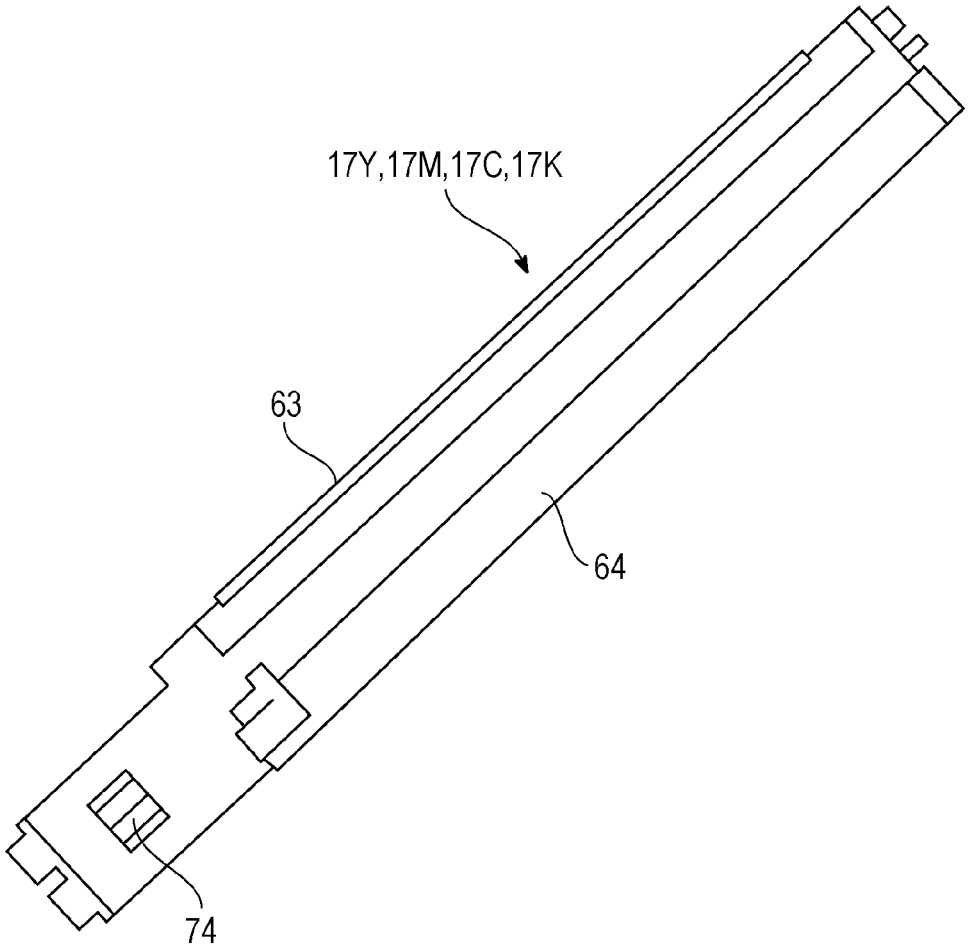
FIG. 8 is a perspective view of the structure of each developing device.

FIG. 8 shows the structure of each developing device to which toner of a corresponding color is supplied from the corresponding one of the developer supplying devices 50Y, 50M, 50C, and 50K.

As shown in FIG. 8, each developing device 17 includes a developing-device housing 64 having an opening 63 in an area opposing the corresponding photoconductor drum 15. In an internal portion of each developing-device housing 64, a developing roller 65 is rotatably disposed at a position that faces the opening 63. A developer chamber 64 that contains two-component developer 66 including toner and a carrier is provided at a back side of each developing roller 65. Each developer chamber 64 is partitioned in two by a partition wall 68. A mixing/supplying auger 69 is rotatably disposed at a side of its corresponding developing roller 65. Each auger 69 serves as a transporting member that supplies the developer 66 to its corresponding developing roller 65 by transporting the developer 66 contained in the developer chamber 67 while mixing the developer 66. A mixing/transporting auger 70 is disposed at a back side of the auger 69. Each auger 70 serves as a transporting member that transports the developer 66 contained in the corresponding developer chamber 67 while mixing the developer 66. The direction of transport of the developer 66 by each mixing/supplying auger 69 and the direction of transport of the developer 66 by each auger 70 are set in opposite directions. The augers 69 and 70 allow the developer 66 to pass so as to transport the developer 66 through paths 71 and 72 that open at respective ends of the corresponding partition wall 68 in a longitudinal direction thereof, to circulate the developer 66 while mixing the developer 66.

Figure 9:
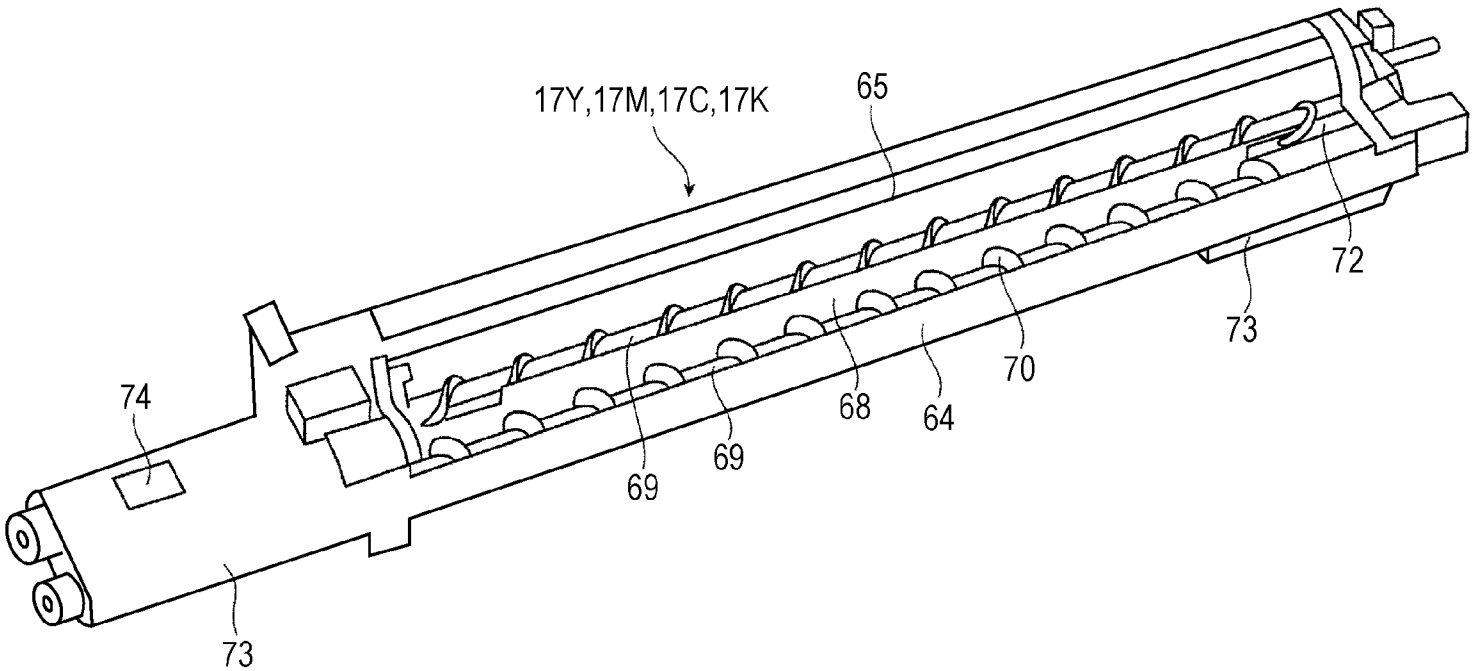
FIG. 9 is a perspective view of the structure of each developing device.

As shown in FIG. 9, a toner density sensor 73 is provided near a downstream end portion of each auger 70 along an axial direction thereof at a bottom portion of the developer chamber 67 in the corresponding developing-device housing 64. Each toner density sensor 73 is, for example, a permeability sensor that detects the density of the toner of the developer 66 contained in the corresponding developer chamber 67.

Figure 10:
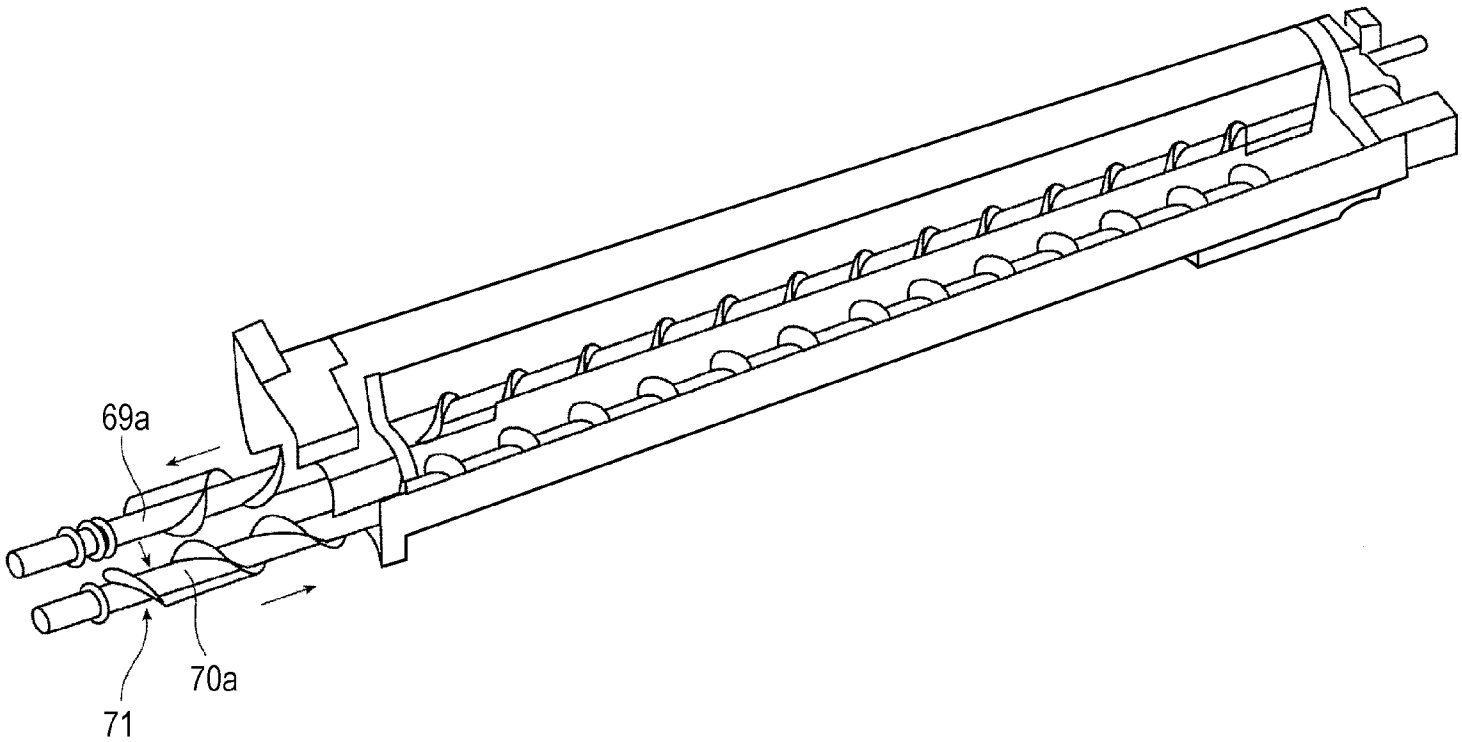
FIG. 10 is a perspective view of the structure of each developing device.

As shown in FIG. 10, an end portion 69*a* of each auger 60 in a longitudinal direction thereof and an end portion 70*a* of each auger 70 in a longitudinal direction thereof extend so as to protrude beyond the corresponding developing roller 65. The toners T of the corresponding colors are such as to drop and to be supplied from the corresponding developer supplying devices 50Y, 50M, 50C, and 50K to the end portions of the extending portions 69*a* and 70*a* of the respective augers 69 and 70.

As shown in FIG. 9, a cover for the extending portions 69*a* and 70*a* cover the extending portions 69*a* and 70*a* of the corresponding augers 69 and 70. In addition, as shown in FIG. 9, a toner receiving opening 74 opens in an upper end surface of each cover. Each toner receiving opening 74 receives the toner T that has dropped and that has been supplied from the corresponding one of the developer supplying devices 50Y, 50M, 50C, and 50K through the drop path 57. The toner T that has been received from the corresponding toner receiving opening 74 is primarily transported into the corresponding developing-device housing 64 along an axial direction by the corresponding mixing/transporting auger 70, is transported while being mixed with the developer 66 contained in the corresponding developer chamber 67, and is supplied to the developing roller 65 by its corresponding auger 69 in order to be used for development.

Each developing roller 65, each mixing/supplying auger 69, and each mixing/transporting auger 70 are rotationally driven by a drive motor (not shown) at a speed corresponding to a process speed. This causes the developer 66 contained in the developer chamber 67 of the corresponding developing-device housing 64 to be transported while being mixed, so that the electrostatic latent image formed on the surface of the corresponding photoconductor drum 15 by its corresponding developing roller 65 is developed.

In the image forming apparatus having the above-described structure, as shown in FIG. 1, the toners in the corresponding developing devices 17Y, 17M, 17C, and 17K are gradually consumed as the electrostatic latent images formed on the surfaces of the photoconductor drums 15Y, 15M, 15C, and 15K of the corresponding image forming sections 13Y, 13M, 13C, and 13K for yellow (Y), magenta (M), cyan (C), and black (K) are developed with the toners of the corresponding colors by the corresponding developing devices 17Y, 17M, 17C, and 17K.

When the toner densities of the developers 66 contained in the corresponding developer chambers 67 are detected by the corresponding toner density sensors 73, and the toner densities in the corresponding developing devices 17Y, 17M, 17C, and 17K become lower than a preset threshold value, the developer supplying devices 50Y, 50M, 50C, and 50K supply the toners T of the corresponding colors to the corresponding developing devices 17Y, 17M, 17C, and 17K at a predetermined timing, such as after completion of the series of image forming operations or directly after forming images on a predetermined number of pieces of recording paper 34. Toner replenishment is performed when necessary when forming images.

The supplying operations of the toners T performed by the corresponding developer supplying devices 50Y, 50M, 50C, and 50K are executed by rotationally driving the agitators 53 in the toner cartridges 51Y, 51M, 51C, and 51K by the corresponding cartridge motors 54Y, 54M, 54C, and 54K as shown in FIG. 4, and by rotationally driving at a predetermined constant speed the two agitators 59 and 60 and the auger 61 of each of the developer storing devices 55Y, 55M, 55C, and 55K by the corresponding one of the toner supply motors 62Y, 62M, 62C, and 62K as shown in FIGS. 5 and 6.

As shown in FIGS. 8 to 10, the developing devices 17Y, 17M, 17C, and 17K to which the toners T are supplied from the developer supplying devices 50Y, 50M, 50C, and 50K are driven at a speed corresponding to the speed of the image forming operation, and the toners T supplied from the developer supplying devices 50Y, 50M, 50C, and 50K are transported into the corresponding developer chambers 67 by the corresponding mixing/supplying augers 69 and the corresponding mixing/transporting augers 70. In addition, as shown in FIGS. 8 to 10, the toners T are transported while being mixed by the corresponding mixing/supplying augers 69 and the corresponding mixing/transporting augers 70, so that the supplied toners T are frictionally electrified by being mixed with the developers 66 in the corresponding developer chambers 67.

Accordingly, in each of the developer supplying devices 50Y, 50M, 50C, and 50K, the toner T is supplied by the two agitators 59 and 60 and the auger 61 that are rotationally driven at a constant speed regardless of the process speed of the image forming apparatus, whereas, in each of the developing devices 17Y, 17M, 17C, and 17K, the mixing/supplying augur 69 and the mixing/transporting auger 70 are rotationally driven at a driving speed that is switched to more than one speed in accordance with the process speed of the image forming apparatus, so that the mixing and transport of the developer 66 including the toner T are executed.

Therefore, in the image forming apparatus, in the case in which an image forming operation is executed at a process speed that is less than 308 mm/s (which is the highest process speed), such as 200 mm/s (which is approximately ⅔ of 308 mm/s or the third highest speed) or 103 mm/s (which is approximately ⅓ of 308 mm/s or the lowest speed), when the toner T is supplied to any one of the developer supplying devices 50Y, 50M, 50C, and 50K, the following may occur. That is, as shown in FIG. 5, the toner T may accumulate at, for example, a lower end of the drop path 57, to which the toner T drops and is supplied from the any one of the developer supplying devices 50Y, 50M, 50C, and 50K to the corresponding one of the developing devices 17Y, 17M, 17C, and 17K, when the capacity of supplying the toner T by the two agitators 59 and 60 and the auger 61 of the any one of the developer supplying devices 50Y, 50M, 50C, and 50K becomes greater than the capacity of transporting the developer by the mixing/supplying auger and the mixing/transporting auger of the corresponding developing device 17.

When the toner T accumulates in the drop path 57 that allows the toner T to drop and to be supplied to the corresponding one of the developing devices 17Y, 17M, 17C, and 17K from the corresponding one of the developer supplying devices 50Y, 50M, 50C, and 50K, for example, the load of accumulated toner T causes excess toner T and developer 66 to adhere to the mixing/supplying auger 69 and the mixing/transporting auger 70 of the corresponding one of the developing devices 17Y, 17M, 17C, and 17K, thereby causing mixing failure and improper transport of the developer 66 and toner T to clog the drop path 57. Therefore, developer density may be reduced because toner is not supplied to the corresponding one of the developing devices 17Y, 17M, 17C, and 17K.

In the exemplary embodiment, the image forming apparatus includes a determining unit and a controller. The determining unit determines whether or not an operation where supplying capacities of the developer supplying devices 50Y, 50M, 50C, and 50K are greater than developer transport capacities of the developing devices 17Y, 17M, 17C, and 17K exceeds a predetermined threshold value and is continued. The controller performs control so that, when the determining unit determines that the operation exceeds the predetermined threshold value and is continued, an operation that was being executed immediately prior to the determination is stopped to forcefully drive the mixing/supplying auger and the mixing/transporting auger of the corresponding one of the developing devices 17Y, 17M, 17C, and 17K for a predetermined driving time.

Figure 11:
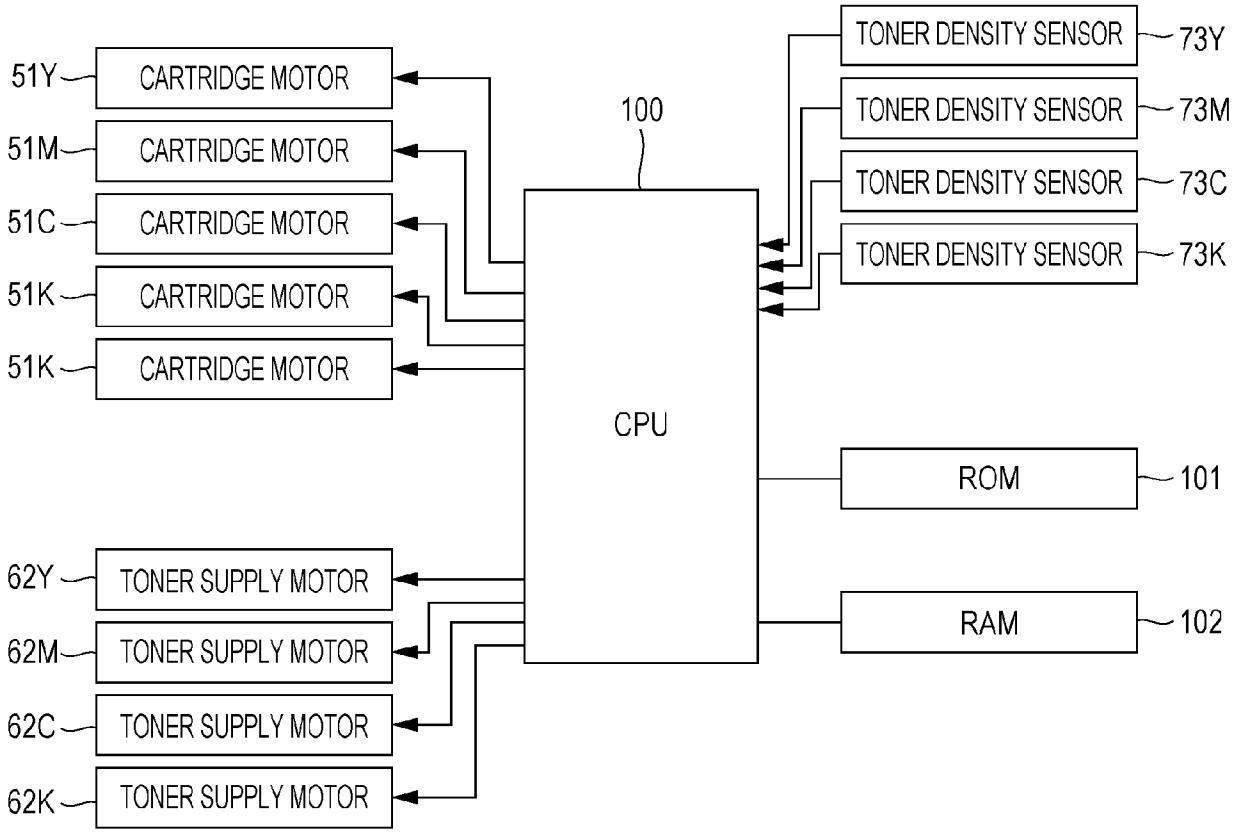
FIG. 11 is a block diagram of a control circuit.

FIG. 11 is a block diagram of a control circuit of the image forming apparatus.

In FIG. 11, reference numeral 100 denotes a central processing unit (CPU) that controls the operation of the entire image forming apparatus and that functions as the determining unit and the controller. The CPU 100 functions as the determining unit and the controller and controls the operation of the entire image forming apparatus while reading, for example, parameters, stored in RAM 102 (such a nonvolatile random-access memory (NVRAM)), as appropriate, on the basis of a program previously stored in ROM 101.

As shown in FIG. 11, output signals from the toner density sensors, provided at the developing devices 17Y, 17M, 17C, and 17K of the corresponding image forming sections 13Y, 13M, 13C, and 13K for yellow (Y), magenta (M), cyan (C), and black (K), are input to the CPU 100. Driving signals for driving the cartridge motors 54Y, 54M, 54C, and 54K, provided at the toner cartridges 51Y, 51M, 51C, and 51K of the corresponding image forming sections 13Y, 13M, 13C, and 13K for yellow (Y), magenta (M), cyan (C), and black (K), are output from the CPU 100 through a drive circuit (not shown). In addition, as shown in FIG. 11, driving signals for driving the toner supply motors 62Y, 62M, 62C, and 62K, provided at the developer storing devices 55Y, 55M, 55C, and 55K of the corresponding image forming sections 13Y, 13M, 13C, and 13K, are output from the CPU 100 through the drive circuit.

In the above-described structure, by performing the following, the image forming apparatus according to the exemplary embodiment can suppress developer clogs caused by the continuation of the operation where the supply capacities of the developer supplying units exceed the transport capacities of the developing units.

That is, in the image forming apparatus, as shown in FIG. 2, toner images of corresponding colors are formed on the photoconductor drums 15Y, 15M, 15C, and 15K of the corresponding image forming sections 13Y, 13M, 13C, and 13K for yellow (Y), magenta (M), cyan (C), and black (K). After the toner images of the corresponding colors formed on the photoconductor drums 15 of the corresponding image forming sections 13Y, 13M, 13C, and 13K have been first-transferred in a superposed state to the intermediate transfer belt 25, the toner images are second-transferred collectively to the recording paper 34 from the intermediate transfer belt 25 at the second transfer position.

As shown in FIG. 2, the recording paper 34 to which the toner images of the corresponding colors, yellow (Y), magenta (M), cyan (C), and black (K), have been second-transferred collectively are heated and pressed by the fixing device 37 to fix the unfixed toner images, after which the recording paper 34 is discharged onto the discharge tray 40, provided at the outer portion of the body 1 of the image forming apparatus.

In the image forming apparatus, the following control is performed when the above-described image forming operations are performed.

Figure 12:
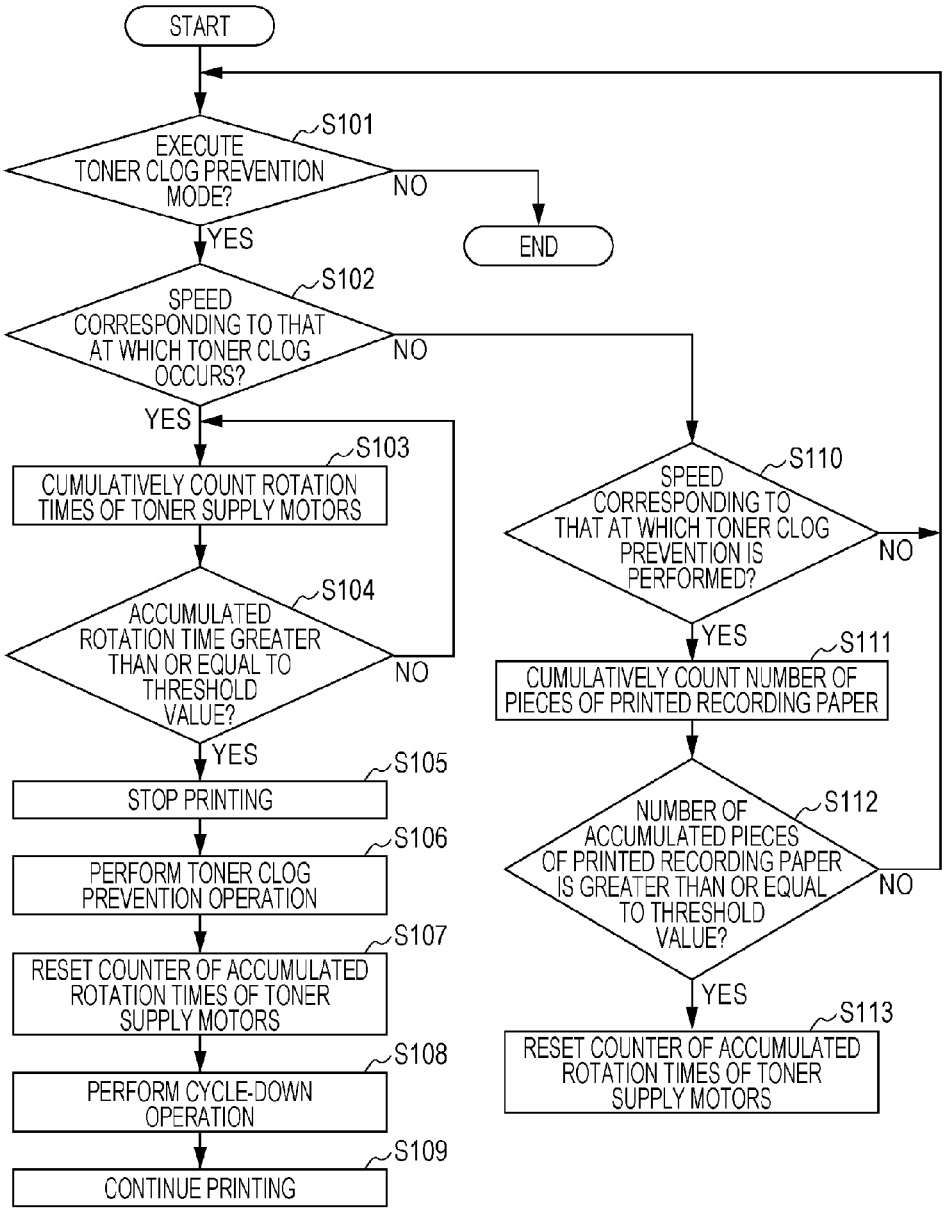
FIG. 12 is a flow chart of the operations of the image forming apparatus according to the first exemplary embodiment of the present invention.

First, as shown in FIG. 12, the CPU 100 determines whether or not the setting is that for executing a toner clog prevention mode in Step S101. When the setting is that for not executing the toner clog prevention mode, the process immediately ends, whereas, when the setting is for executing the toner clog prevention mode, the CPU 100 determines whether or not the process speed that is set in an image forming operation that is being executed is a speed at which a toner clog occurs (which is a process speed stored in RAM 102) in Step S102. As the speed at which a toner clog occurs, for example, a speed other than 308 mm/s (which is the highest process speed), that is, 255 mm/s, 200 mm/s, or 103 mm/s is set. However, the speed is not limited thereto. For example, a speed other than 308 mm/s (which is the highest process speed) and 255 mm/s (which is the next highest process speed), that is, 200 mm/s or 103 mm/s may be set.

As shown in FIG. 11, when the CPU 100 determines that the process speed that is set is a speed at which a toner clog occurs, that is, a process speed other than 308 mm/s (which is the highest process speed), that is, any one of 255 mm/s, 200 mm/s, and 103 mm/s, the CPU 100 cumulatively counts the rotation times of the toner supply motors 62Y, 62M, 62C, and 62K in Step S103, and determines whether or not the accumulated rotation time of any one of the toner supply motors 62Y, 62M, 62C, and 62K is greater than or equal to a threshold value, stored in RAM 102, in Step S104. When the accumulated rotation time of any one of the toner supply motors 62Y, 62M, 62C, and 62K is less than the threshold value stored in RAM 102, the process returns to Step S103. Alternatively, when the accumulated rotation time of any one of the toner supply motors 62Y, 62M, 62C, and 62K is less than the threshold value stored in RAM 102, the process may return to Step S101.

In contrast, in the CPU 100, as shown in FIG. 12, when the accumulated rotation time of any one of the toner supply motors 62Y, 62M, 62C, and 62K is greater than or equal to the threshold value stored in RAM 102, a printing operation is stopped and a cycle-down operation is executed in Step S105, after which the process speed is switched to 308 mm/s (which is the highest process speed), to execute a toner clog prevention operation. As the toner clog prevention operation, for example, as shown in FIG. 13, a cycle-up operation is executed, and a toner breakage operation and a density adjustment operation in a process control operation are executed.

Figure 13:
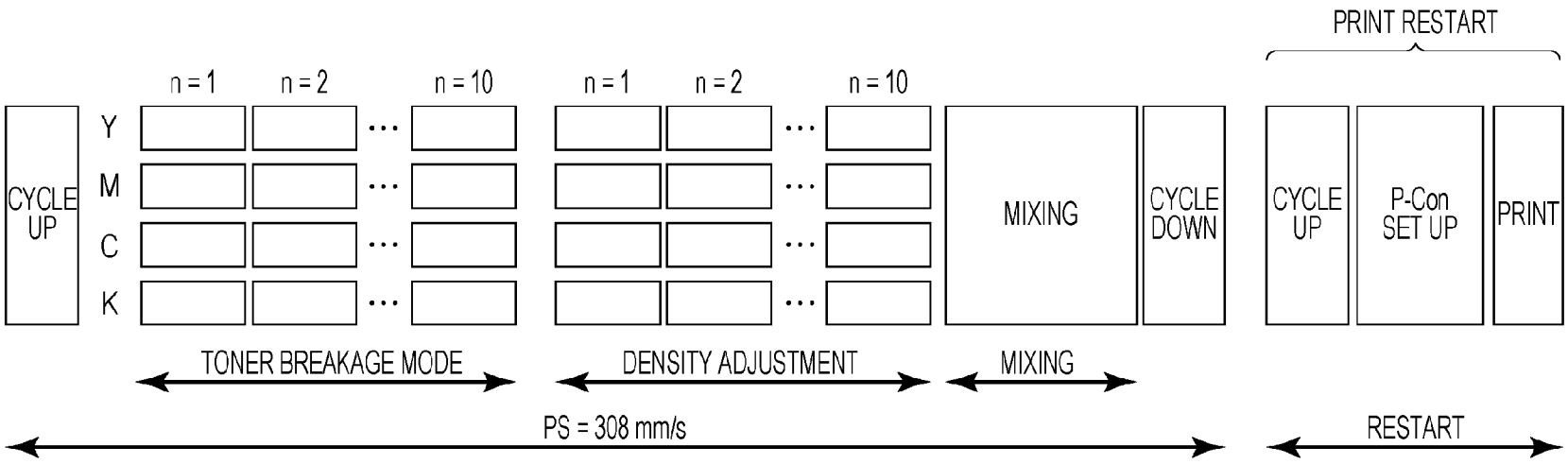
FIG. 13 illustrates a toner clog prevention operation.

As an operation of reducing toner density in the process control operation, for example, as shown in FIG. 13, in the image forming sections 13Y, 13M, 13C, and 13K for yellow (Y), magenta (M), cyan (C), and black (K), uniform halftone images (having a density of, for example, 10%) are formed on, for example, a predetermined number of pieces of A4-size recording paper 34 (such as approximately 20 pieces of recording paper 34), to forcefully consume the toner T that has been supplied to the developing device 17 up to this time. Here, the supply of toner to the developing device 17 is prohibited. The operation of forcefully consuming the toner T may only be performed on the developing device 17 where the accumulated rotation time of the corresponding one of the toner supply motors 62Y, 62M, 62C, and 62K is determined as being greater than or equal to a set value that is stored in RAM 102, or on more than one of the developing devices 17 where the accumulated rotation times of the corresponding toner supply motors are determined as being greater than or equal to the set value that is stored in RAM 102.

In the toner clog prevention operation, when necessary, it is determined whether or not the operation of reducing the toner density of the process control operation has been executed for a set number of times that is stored in RAM 102. When the operation has not been performed for the set number of times, the image forming apparatus waits until the operation is performed for the set number of times, after which idle rotation is executed. Idle rotation is performed for maintaining the toner densities in the developing devices 17 at proper values. The idle rotation is performed while forming uniform halftone images (having a density of, for example, 10%) on, for example, a predetermined number of pieces of A4-size recording paper 34 (such as approximately 20 pieces of recording paper 34) while supplying toner under ordinary conditions to the developing devices 17 in the corresponding image forming sections 13Y, 13M, 13C, and 13K for yellow (Y), magenta (M), cyan (C), and black (K) as shown in FIG. 13.

Thereafter, in the toner clog prevention operation, it is determined whether or not the idle rotation has been executed for the set number of times that is stored in RAM 102. When the idle rotation has not been executed for the set number of times, the image forming apparatus waits until the idle rotation is performed for the set number of times, and cumulatively counts how many times these operations for the corresponding colors have been executed.

Next, as shown in FIG. 13, in the toner clog prevention operation, a mixing operation is executed in a corresponding one of the developing devices 17.

Thereafter, as shown in FIG. 12, the CPU 100 causes count values of the accumulated rotation times of the corresponding toner supply motors 62Y, 62M, 62C, and 62K to be reset in Step S107, and causes a cycle-down operation to be executed in Step S108. As shown in FIG. 13, in Step S109, printing is continued after a cycle-up operation.

In contrast, as shown in FIG. 12, when, in Step S102, the CPU 100 determines that the process speed that is set is not the speed at which a toner clog occurs, the CPU 100 determines whether or not the process speed that is set is the speed at which the toner clog prevention operation is executed in Step S110. When the CPU 100 determines that the process speed that is set is not the speed at which the toner clog prevention operation is executed, the process returns to Step S101.

When the CPU 100 determines that the process speed that is set is the speed at which the toner clog prevention operation is executed, the CPU 100 cumulatively counts the number of pieces of recording paper 34 on which images have been printed, after conversion to the number of pieces of A4 LEF recording paper at 308 mm/s (which is the process speed that is set) in Step S111.

The CPU 100 determines whether or not a value obtained by cumulatively counting the number of pieces of recording paper 34 on which the images have been printed is greater than or equal to a previously stored threshold value in Step S112. When the CPU 100 determines that the value is not greater than or equal to the previously stored threshold value, the process returns to Step S101. In contrast, when the CPU 100 determines that the value is greater than or equal to the previously stored threshold value, the count values of the accumulated use of the number of pieces of recording paper 34 as the operation is performed are reset in Step S113.

In the exemplary embodiment, as shown in FIG. 12, the CPU 100 determines whether or not the process speed is, for example, other than 308 mm/s (which is the highest speed). When the CPU 100 determines that the process speed is, for example, other than 308 mm/s (which is the highest speed), and that the accumulated rotation time of any one of the toner supply motors 62Y, 62M, 62C, and 62K is greater than or equal to the threshold value stored in RAM 102, the CPU 100 causes the printing to be stopped and to execute the operation of forcefully consuming the toner in the corresponding developing device 17. This makes it possible to suppress or prevent, for example, a reduction in image density caused by a toner clog, or a mixing failure or an improper transport of the developers 66 when the capacities of supplying the toners T by the developer supplying devices 50Y, 50M, 50C, and 50K become greater than the capacities of transporting the developers by the developing devices 17.

Second Exemplary Embodiment

Figure 14:
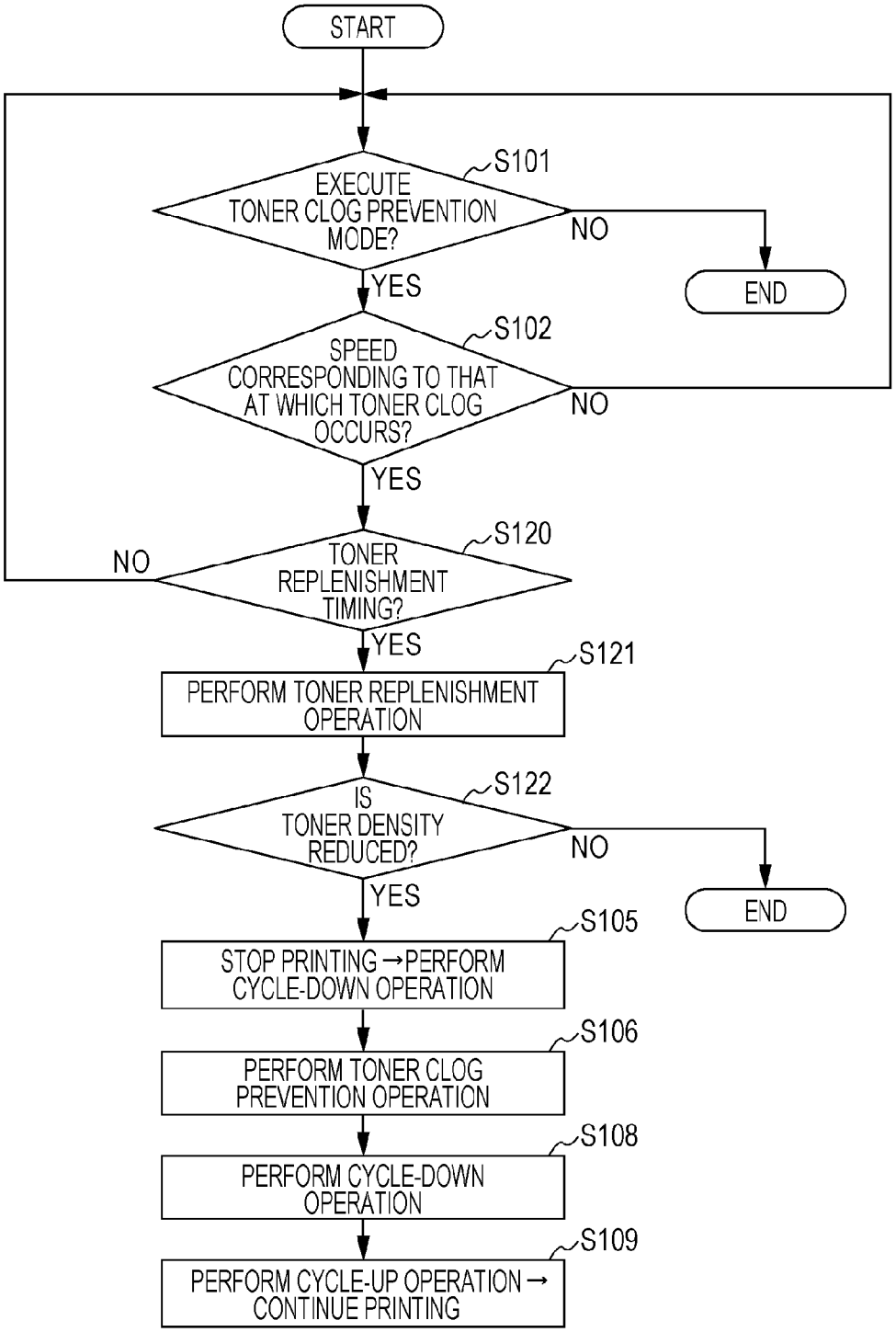
FIG. 14 is a flow chart of the operation of an image forming apparatus according to a second exemplary embodiment of the present invention.

FIG. 14 illustrates a second exemplary embodiment of the present invention. Portions corresponding to those of the previous exemplary embodiment will be given the same reference numerals. In the second exemplary embodiment, the determining unit is formed so that, when the developer density in the developing unit immediately after supplying the developer to the corresponding one of the developing units from the corresponding one of the developer supplying units is less than a predetermined density, the determining unit determines that an operation where the supplying capacity of the developer supplying unit is greater than the developer transport capacity of the developing unit exceeds a predetermined threshold value and is continued.

That is, in the second exemplary embodiment, as shown in FIG. 14, the CPU 100 determines whether or not the setting is that for executing a toner clog prevention mode in Step S101. When the setting is that for not executing the toner clog prevention mode, the process immediately ends, whereas, when the setting is for executing the toner clog prevention mode, the CPU 100 determines whether or not the process speed that is set in an image forming operation that is being executed is a speed at which a toner clog occurs (which is a process speed stored in RAM 102) in Step S102. Here, as the speed at which a toner clog occurs, for example, a speed other than 308 mm/s (which is the highest process speed), that is, 255 mm/s, 200 mm/s, or 103 mm/s is set. However, the speed is not limited thereto. For example, a speed other than 308 mm/s (which is the highest process speed) and 255 mm/s (which is the next highest process speed), that is, 200 mm/s or 103 mm/s may be set.

As shown in FIG. 14, when the CPU 100 determines that the process speed that is set is a speed at which a toner clog occurs, that is, a process speed other than 308 mm/s (which is the highest process speed), that is, any one of 255 mm/s, 200 mm/s, and 103 mm/s, the CPU 100 determines whether or not a timing is a toner replenishment timing in Step S120. When the CPU 100 determines that the timing is the toner replenishment timing, a toner replenishment operation is executed in Step S121.

As shown in FIG. 14, the CPU 100 determines whether or not the toner density in the developing device 17 at which the toner replenishment operation is executed is less than a specified value that is previously stored in RAM 102 in Step S122. When the CPU 100 determines that the toner density is greater than or equal to the specified value that is previously stored in RAM 102, the process immediately ends.

In contrast, when the CPU 100 determines that the toner density is less than the specified value that is previously stored in RAM 102, as in the first exemplary embodiment, a printing operation is stopped and a cycle-down operation is executed in Step S105. Subsequently to this, the operations from Steps S106 to S109 excluding Step S107 are executed.

In the second exemplary embodiment, when, after executing the toner replenishment operation, the CPU 100 determines that the toner density is less that the specified value that is previously stored in RAM 102, the CPU 100 determines that, for example, toner is clogging the toner supply path, and causes an operation that does not forcefully consume the toner to be executed. This makes it possible to suppress or prevent, for example, a reduction in image density caused by a toner clog, or a mixing failure or an improper transport of the developers 66 when the capacity of supplying the toner T by any one of the developer supplying devices 50Y, 50M, 50C, and 50K becomes greater than the capacity of transporting the developer 66 by the corresponding one of the developing devices 17.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that carries an electrostatic latent image;

a developer supplying unit that supplies developer by being driven at a predetermined speed;

a developing unit that develops the electrostatic latent image carried by the image carrier, while a transporting member transports the developer that is supplied from the developer supplying unit, a transport speed of the transporting member being switched between a highest transport speed and a lower speed lower than the highest transport speed;

a determining unit that determines whether or not a first accumulated driving time exceeds a first predetermined threshold value, the first accumulated driving time being obtained by accumulating times in which the transporting member of the developing unit is driven at the lower speed; and a controller that performs control so that, when the determining unit determines that the first accumulated driving time exceeds the predetermined threshold value, an operation that was being executed immediately prior to the determination is stopped to forcefully drive the transporting member of the developing unit for a predetermined driving time and develop a uniform density image.

2. The image forming apparatus according to claim 1, wherein the controller forcefully drives the transporting member of the driving unit at the highest transport speed.

3. The image forming apparatus according to claim 1, wherein, when the determining unit determines that the transporting member of the developing unit has been driven at the highest transport speed for a second accumulated time that is greater than a second predetermined accumulated driving time, the first accumulated driving time is initialized.

4. The image forming apparatus according to claim 1, wherein the controller executes forceful driving of the transporting member of the developing unit while the supply of the developer by the developer supplying unit is prohibited.

5. The image forming apparatus according to claim 1, wherein the controller executes forceful driving of the transporting member of the developing unit while an electrostatic latent image other than that for an image carried by a surface of the image carrier is developed.

* * * * *